US007608127B2

(12) United States Patent
Lin et al.

(10) Patent No.: US 7,608,127 B2
(45) Date of Patent: Oct. 27, 2009

(54) PARTICLE REINFORCED NOBLE METAL MATRIX COMPOSITE AND METHOD OF MAKING SAME

(75) Inventors: Ray Y. Lin, Cincinnati, OH (US); Donald E. Stafford, Loveland, OH (US)

(73) Assignee: The University of Cincinnati, Cincinnati, OH (US)

( * ) Notice: Subject to any disclaimer, the term of this patent is extended or adjusted under 35 U.S.C. 154(b) by 0 days.

(21) Appl. No.: 12/035,798

(22) Filed: Feb. 22, 2008

(65) Prior Publication Data

US 2008/0176063 A1 Jul. 24, 2008

Related U.S. Application Data

(63) Continuation of application No. 10/974,229, filed on Oct. 27, 2004, now abandoned.

(51) Int. Cl.
*C22C 5/02* (2006.01)
*C22C 32/00* (2006.01)

(52) U.S. Cl. ..... 75/247; 75/240

(58) Field of Classification Search ..... 75/240, 75/247

See application file for complete search history.

(56) References Cited

U.S. PATENT DOCUMENTS

| | | | | |
|---|---|---|---|---|
| 3,069,759 | A | 12/1962 | Grant et al. | |
| 3,158,469 | A | 11/1964 | Kosco et al. | |
| 3,459,915 | A * | 8/1969 | Kenney et al. | 75/240 |
| 3,460,920 | A | 8/1969 | Long et al. | |
| 3,685,134 | A * | 8/1972 | Blue | 419/23 |
| 3,827,883 | A * | 8/1974 | Neely | 419/18 |
| 3,969,570 | A | 7/1976 | Smith | |
| 4,088,480 | A | 5/1978 | Kim et al. | |
| 4,137,076 | A | 1/1979 | Hoyer et al. | |
| 4,309,458 | A | 1/1982 | Kawasumi et al. | |
| 4,374,086 | A | 2/1983 | Desai | |
| 4,409,037 | A | 10/1983 | Landau | |
| 4,450,135 | A | 5/1984 | Peters et al. | |
| 4,512,818 | A | 4/1985 | Valayil et al. | |
| 4,530,875 | A | 7/1985 | Donomoto et al. | |
| 4,551,596 | A | 11/1985 | Watanabe et al. | |
| 5,045,972 | A | 9/1991 | Supan et al. | |
| 5,059,255 | A | 10/1991 | Muller | |
| 5,139,739 | A | 8/1992 | Takayanagi et al. | |
| 5,164,026 | A | 11/1992 | Muller | |
| 5,180,551 | A | 1/1993 | Agarwel | |
| 5,681,617 | A | 10/1997 | Lin et al. | |
| 5,697,421 | A | 12/1997 | Lin et al. | |
| 6,174,388 | B1 | 1/2001 | Sikka et al. | |
| 6,312,495 | B1 | 11/2001 | Renner et al. | |
| 6,868,848 | B2 | 3/2005 | Boland et al. | |

FOREIGN PATENT DOCUMENTS

| | | |
|---|---|---|
| GB | 1005461 | 9/1965 |

OTHER PUBLICATIONS

Baginski, Thomas A., An Introduction to Gold Gettering In Silicon and a Discussion of Intrinsic Gettering, Gold Bulletin, 1987, pp. 47-53, 20, (3).

Rapson, W.S., The Science and Technology of Gold, Gold Bulletin, 1988, pp. 10-16, 21, (1).

Nowicki, Ronald S., Diffusion Barriers Between Gold and Semiconductors, Gold Bulletin, 1982, pp. 21-23, 15, (1).

Oguchi, Hachiro, Japanese Shakudo, Gold Bulletin, 1983, pp. 125-132, 16, (4).

Quobo, Li, et al., Solid Solubility Metastable Extension of Some Transition Metals in Gold, Gold Bulletin, 1998, pp. 30-32, 31, (1).

Bartlett, Neil, Relativistic Effects and the Chemistry of Gold, Gold Bulletin, 1998, pp. 22-25, 31, (1).

Kempf, Bernd, et al., Thermodynamic Modelling of Precious Metals Alloys, Gold Bulletin, 1998, pp. 51-57, 31, (2).

Takahashi, S., et al., Design Opportunities Through Innovative Materials, pp. 12-17, Mitsubishi Materials Corp., Sanda plant, Sanda City, Hyogo, Japan.

Deshpande, Pranav K., Copper-Tungsten Carbide Composites With Infrared Processing, Master's Thesis, College of Engineering, University of Cincinnati, Cincinnati, Ohio, published Sep. 16, 2002.

Lin, Ray Y., et al., Innovative Infrared Processing of Metal Matrix Composites, Proceedings of the 19th Annual Conference on Composites, Advanced Ceramics, Materials, and Structures, 1995, pp. 163-172.

Warrier, S.G. et al., Liquid State Infrared Processing of SCS-6/Ti-6Al-4V Composites, Metallurgical and Materials Transactions B, vol. 27B, Jun. 1996, pp. 527-532.

Warrier, S.G., et al., Interface Characterization of Ceramic Fiber-Reinforced Ti Alloy Composites Manufactured by Infrared Processing, Metallurgical and Materials Transactions A, vol. 27A, May 1996, pp. 1379-1394.

Warrier, S.G., et al., Interfacial Reactions In Titanium/SCS Fiber Compositions During Fabrication, Scripta Metallurgica et Materialia, vol. 28, 1993, pp. 313-318.

(Continued)

*Primary Examiner*—Roy King
*Assistant Examiner*—Ngoclan T Mai
(74) *Attorney, Agent, or Firm*—Wood, Herron & Evans, L.L.P.

(57) ABSTRACT

The present invention relates to particle reinforced noble metal matrix composites and a method of making the same. The composites include a noble metal such as silver, gold, and alloys thereof, as a base or matrix, and a particle reinforced filler material, such as a carbide. A pressureless infrared heating, or superheating, process is used to produce the particle reinforced noble metal matrix composites thereby providing a composite with at least sufficient hardness, i.e. wear resistance, and/or low resistivity. The composites may be used in the jewelry industry, such as for making watches, rings, and other jewelry, and/or in the power, automobile, and aircraft industries, such as for making electrical contact materials.

3 Claims, No Drawings

OTHER PUBLICATIONS

Warrier, S.G., et al., TiC Growth In C Fiber/Ti Alloy Composites During Liquid Infiltration, Scripta Metallurgica et Materialia, vol. 29, 1993, pp. 147-152.
Warrier, S.G., et al., Fabrication and Properties of Infrared Processed SCS-2/A1 Composites, Scripta Metallirgica et Materialia, vol. 31, No. 4, 1994, pp. 491-496.
Warrier, S.G., et al., Infrared Processed Aluminum Matrix Composites and Carbide Formation At the Interface, Scripta Matallurgica et Materialia, vol. 29, 1993, pp. 1513-1518.
Blue, Craig A., et al., Rapid Infrared Joining of Titanium Alloys and Titanium Matrix Composites, Mat. Res. Symp. Proc., vol. 314, 1993, pp. 143-148.
Warrier, S.G., et al., Infiltration of Titanium Alloy-Matrix Composites, Journal of Materials Science Letters, vol. 12, 1993, pp. 865-868.
Warrier, S.G., et al., Fabrication of Aluminum and Titanium Matrix Composites by Infrared Pressureless Infiltration, Proceedings of the American Society of Composites, Eighth Technical Conference, 1993, pp. 561-569.
Warrier, S.G., et al., Infrared Infiltration and Properties of SCS-6/Ti Alloy Composites, Journal of Materials Science, vol. 31, 1996, pp. 1821-1828.
Warrier, S.G., et al., Control of Interfaces in Al-C Fibre Composites, Journal of Materials Science, vol. 28, 1993, pp. 760-768.
Warrier, S.G., et al., Silver Coating On Carbon and SiC Fibres, Journal of Materials Sciences, vol. 28, 1993, pp. 4868-4877.
Gao, Feng, et al., Theoretical Modeling of the Oxidation of Carbon/Carbon Composites, EPD Congress, 1993, pp. 521-534.
Warrier, Sunil G., et al., Rapid Infrared Forming of Titanium/SCS Fiber Composites, EPD Congress, 1993, pp. 643-653.
Warrier, Sunil G., et al., Using Rapid Infrared Forming to Control Interfaces in Titanium-Matrix Composites, JOM, Mar. 1993, pp. 24-27.
Wu, S.K., et al., Electron Microscopic Studies of Infrared Processed Aluminum Matrix Composites, Control of interfaces in Metal and Ceramics Composites, The Minerals, Metals, and Materials Society, ed. by R.Y. Lin and S.G. Fishman, 1993, pp. 275-283.
Warrier, S.G., et al., Carbide Formation in Infrared Processed Nicalon Fiber/Aluminum Composites, Control of interfaces in Metal and Ceramics Composites, The Minerals, Metals, and Materials Society, ed. by R.Y. Lin and S.G. Fishman, 1993, pp. 95-106.
Lin, R.Y., et al., Interface Control in Metal Matrix Composite Fabrication, Control of interfaces in Metal and Ceramics Composites, The Minerals, Metals, and Materials Society, ed. by R.Y. Lin and S.G. Fishman, 1993, pp. 33-49.
Lin, Ray Y., et al., Composite Interfacial Reactions, JOM Mar. 1993, p. 20.
Lin, Ray Y., et al., The Infrared Infiltration and Joining of Advanced Materials, JOM, Mar. 1994, pp. 26-30.
Lin, Ray Y., et al., Interface Evolution in Aluminum Matrix Composites During Fabrication, Key Engineering Materials, vols. 104-107, 1995, pp. 507-522.
Lin, Ray Y., et al., Infrared Aluminum Matrix Composites and Carbide Formation, Proceedings of ICCM-10, Whistler, B.C. Canada, Aug. 1995, pp. II-271-II-278.
Warrier, Sunil G., et al., Interactions Between SiC Fibers and a Titanium Alloy During Infrared Liquid Infiltration, Metallurgical and Materials Transactions A, vol. 26A, Jul. 1995, pp. 1885-1894.
Warrier, S.G., et al., Physical Chemistry of Interfacial Reactions During the Fabrication of Titanium Matrix Composites, Proceedings of the ICCM/9, Madrid, Jul. 1993, pp. 720-727.
Warrier, S.G., et al., Infrared Liquid State Processing of SCS-6/Ti-6A1-4V Composites, Proc. TMS Fall Meeting, Chicago, Dec. 1995, pp. 45-53.
Warrier, Sunil G., et al., Low Cost Processing of Metal Matrix Composites Using Infrared Heating, TMS Fall Meeting, Chicago, Dec. 1995, pp. 507-515.
Blue, C.A., et al., Infrared Joining of Titanium Matrix Composites, Proceedings of the American Society for Composites, Eighth Technical Conference, 1993, pp. 903-908.
European Patent Office, European Search Report in corresponding EP Application Serial No. 05857824.6-2122, Jan. 30, 2008, 12 pages.
Jiunn-Horng Lin et al., Physical Properties of Composites, Proceedings of Symposium Held During the 125th TMS Annual Meeting and Exhibition, Anaheim, CA, Feb. 4-8, 1996, pp. 57-62, The Minerals, Metals & Materials Society, Warrendale, PA.

* cited by examiner

PARTICLE REINFORCED NOBLE METAL MATRIX COMPOSITE AND METHOD OF MAKING SAME

CROSS-REFERENCE TO RELATED APPLICATIONS

This application is a continuation of U.S. patent application Ser. No. 10/974,229, filed Oct. 27, 2004 (pending), the disclosure of which is hereby incorporated by reference herein.

FIELD OF THE INVENTION

The present invention pertains generally to metal matrix composite materials and, more particularly, to particle reinforced noble metal matrix composites and a method of making the same.

DESCRIPTION OF RELATED ART

Generally, composite materials consist of a bulk or base material, i.e. a matrix, and a filler reinforcement material, such as fibers, whiskers, or particles. The composite materials can be classified into three categories: 1) polymer, 2) metal, and 3) ceramic depending on the matrix employed, and can be further divided depending on the type of reinforcement material provided. These further divisions include dispersion strengthened, particle reinforced, or fiber reinforced type composites.

In the production of particle reinforced metal matrix composites, two or more materials, such as a metal and a particle material, may be combined together in a certain order on a macroscopic level to form a new material with potentially different and attractive properties. These attractive properties may include improved hardness, conductivity, density yield, etc. Generally, a composite is developed for use in a desired industry, such as the jewelry industry, with an eye toward improving at least one or more of the above noted properties and/or improving the method of making thereof, for example, by reducing production time to reduce costs.

Methods for fabricating metal matrix composites vary and can include conventional powder metallurgy, in-situ using laser technology, electroless plating, hot pressing, and liquid metal infiltration. Each process includes advantages and disadvantages that may change dependent upon the material(s) used in making the metal composite. New and improved metal composites may be developed through new methods or by adapting existing methods, which may themselves be improved. For example, tungsten carbide reinforced copper matrix composites have been made, utilizing liquid metal infiltration, via an infrared heating process to produce a metal matrix composite having good hardness, conductivity, and density. Infrared processing also has been successfully used for joining advanced materials such as titanium-matrix composites, titanium aluminide, iron aluminide, nickel aluminide, titanium alloys, nickel based superalloys, carbon-carbon composites, and silicon carbide and carbon fiber reinforced titanium and aluminum matrix composites.

Notably, infrared heating technology has been developing over about the last decade or so and is based on the generation of radiation by means of tungsten halogen lamps with a filament temperature of about 3000° C. Due to the selective absorption of infrared radiations and its cold wall process, it provides faster heating and cooling rates and has proved to be a quick, efficient, and energy conserving heating source.

While tungsten carbide reinforced copper matrix composites and other metal composites, as well as the production thereof by infrared heating, are known, to-date it appears unknown to produce particle reinforced noble metal matrix composites via infrared heating. These particle reinforced noble metal matrix composites include a noble metal, as the base, and a particle filler material, such as a carbide, that is added to improve the properties of the resulting composite. Noble metals, also referred to as noble metals, are understood to include silver, gold, the six platinum-group metals (platinum, palladium, ruthenium, rhodium, osmium, and iridium), and alloys thereof. These noble metals are seen in our everyday lives and are used extensively in jewelry, tableware, electrical contacts, etc.

Each of the above noted noble metals, in general, include distinct individual characteristics from metals that must be considered when producing a particle reinforced noble metal matrix composite via infrared heating. These characteristics coupled with the understanding that the infrared heating process itself includes at least two parameters that appear to be critical to form a metal composite: 1) temperature, which is critical for superheating and for sufficient viscosity of the metal, and 2) pressure, which is important in forcing liquid metal into the particle material, results in great efforts when attempting to produce, via infrared heating, a particle reinforced noble metal matrix composite of sufficient quality.

The jewelry industry is one industry that stands to benefit from particle reinforced noble metal composites that are provided with at least sufficient wear resistance and that are produced in a manner that reduces the labor and time required for processing thereof thereby reducing overall production and purchase costs. In addition, the auto, aviation, and power industries similarly are always seeking improved materials, such as for use in electrical contacts, which offer low resistance/high conductivity and which also are produced in a cost effective manner.

There is thus a need for a particle reinforced noble metal matrix composite having desired properties, such as good hardness and/or low resistivity, that reduces the labor and time required for processing thereof thereby reducing overall production costs wherein the composite may be used in the jewelry industry, such as for making watches, rings, and other jewelry, and/or in the power, automobile, and aircraft industries, such as for making electrical contact materials.

SUMMARY OF THE INVENTION

The present invention provides for particle reinforced noble metal matrix composites having sufficient hardness, i.e. good wear resistance, and low resistivity, and a method of making the same.

Particle reinforced noble metal matrix composites including a noble metal, as the base, and a particle filler material, such as a carbide, are formed via an infrared heating process that includes the infiltration of a liquid noble metal within the interstitial spaces of a porous particle material preform, and subsequent solidification thereof. With respect to noble metals, this group can include silver, gold, platinum, palladium, ruthenium, rhodium, osmium, iridium, and alloys thereof. In addition, the particle filler material includes carbides, such as tungsten and molybdenum carbide, having particle sizes greater than 0.1 μm but less than about 1000 μm.

Concerning the noble metal alloys, silver alloys should include at least about 50% silver, advantageously no less than about 90%. The gold alloys should include no less than about 41% gold, advantageously no less than about 58%. And, each of the platinum group metal alloys should include no less than about 50% of platinum, palladium, ruthenium, rhodium, osmium, or iridium, advantageously no less than about 93%.

The particle reinforced noble metal matrix composites of the present invention include desirable properties, such as sufficient hardness, low resistivity, and/or high density, and are prepared generally according to the following method. A noble metal and a precast particle material are heated by infrared heating to a temperature above the melting point of the noble metal thereby producing a molten noble metal. The particle material is contacted with the molten noble metal in an inert atmosphere at standard atmospheric pressure for a period of time sufficient to allow the molten noble metal to infiltrate the particle material. The molten metal then is solidified within the interstitial spaces of the preform by cooling the particle reinforced noble metal matrix composite to about room temperature. The liquid noble metal infiltration is carried out without the application of any pressure on the liquid metal. Notably, the threshold pressure at the infiltration front is overcome due to the wetting characteristics between the carbide materials and the noble metals. Advantageously, the particle reinforced noble metal matrix composite includes a noble metal content of at least 56% by weight.

In exemplary embodiments, the particle reinforced noble metal matrix composite includes gold or alloys thereof, advantageously red, green, yellow, or white gold alloys, and the particle reinforcement material includes either tungsten or molybdenum carbide. The composites are produced by the infrared heating process generally discussed above wherein a precast carbide material is contacted with the noble metal at a temperature above the melting point of the noble metal to form the composite. More specifically, the gold and gold alloys are heated in a chamber by a tungsten halogen lamp to a temperature of about 1250° C. at a rate of no greater than about 100° C./sec to produce a molten metal. The molten metal is allowed to contact and infiltrate the carbide material for about 240 seconds to form a composite material. The composite then is cooled down to room temperature such as at about a rate of 20° C./sec. Advantageously, the particle reinforced gold or gold alloy matrix composites include a resistivity of no greater than about 1.3E-04 ohm centimeters, a Vickers hardness of at least 171, and a density value of at least 97% of a theoretical density value. In addition, various colored composites, such as pink, green, yellow, and white, are produced as a result of the gold or gold alloy.

In another exemplary embodiment, the particle reinforced noble metal matrix composite include silver or alloys thereof and the particle reinforcement material includes tungsten carbide. The composites are produced by the infrared heating process discussed below wherein a precast tungsten carbide material is contacted with the noble metal at a temperature above the melting point of the noble metal to form the composite. More specifically, the silver and silver alloys similarly are heated in a chamber by a tungsten halogen lamp to a temperature of about 1250° C. at a rate of no greater than about 100° C./sec and allowed to contact and infiltrate the tungsten carbide material for about 240 seconds to form the composite. The composite then is cooled down to room temperature such as at about a rate of 20° C./sec. Advantageously, particle reinforced pure silver matrix composites include a resistivity of no greater than about 4.9E-06 ohm centimeters, a Vickers hardness of at least 251, and a density value of at least 97% of a theoretical density value.

By virtue of the foregoing, there is thus provided a particle reinforced noble metal matrix composite having at least sufficient hardness and/or low resistivity such that the composite may be used in the jewelry industry, such as for making watches, rings, and other jewelry, and/or in the power, automobile, and aircraft industries, such as for making electrical contact materials, and a method of making the same.

The features and objectives of the present invention will become more readily apparent from the following Detailed Description

DETAILED DESCRIPTION OF VERSIONS OF THE INVENTION

The present invention provides for particle reinforced noble metal matrix composites having desired properties, such as sufficient hardness and/or low resistivity, and a method of making the same.

To this end, an infrared heating process is used to prepare the particle reinforced noble metal matrix composites having a noble metal, as a base, and a particle reinforcing filler material, such as a carbide material, advantageously tungsten or molybdenum carbide.

The noble metals include silver, gold, platinum, palladium, ruthenium, rhodium, osmium, iridium, and alloys thereof, advantageously gold, silver, and alloys thereof, more advantageously, silver and gold alloys. Concerning the noble metal alloys, silver alloys should include at least about 50% silver, advantageously no less than about 90%. The gold alloys should include no less than about 41% gold, advantageously no less than about 58%. And, each of the platinum group metal alloys should include no less than about 50% of platinum, palladium, ruthenium, rhodium, osmium, or iridium, advantageously no less than about 93%. In addition, the particle materials may include oxides, such as iron, nickel, manganese, zinc, and chromium oxides, and the like, and the carbide materials may further include silicon, and calcium carbides, and the like. The particle material should include particle sizes greater than 0.1 μm but less than about 1000 μm.

Concerning the infrared heating process, this process includes heating, or superheating, a noble metal and a precast particle material, such as a carbide preform, in a furnace chamber using an infrared heat source, such as a tungsten halogen lamp. The infrared light may include any infrared wavelength, and advantageously a wavelength of from about 0.6 μm to about 10 μm. The infrared heating is performed in an inert atmosphere, advantageously a nitrogen, helium, or argon atmosphere, most advantageously an argon atmosphere, at standard atmospheric pressure, and at a rate of no greater than about 100° C./sec to a temperature greater than the melting point of the noble metal, advantageously 1150° C. to 1350° C., more advantageously 1,200° C. to 1300° C., most advantageously 1250° C., to produce a molten noble metal.

The noble metal is allowed to contact the preform at the temperature above the melting point of the noble metal for a period of sufficient to infiltrate the particle material to form the particle reinforced noble metal matrix composite. Advantageously, this period of time is about 60 to 600 seconds, more advantageously 120 to 480 seconds, and most advantageously 240 seconds. In general, infiltration of the preform is progressive because the noble metal first fills large pores then small pores in the preform. Notably, surface energy differences act to promote infiltration, i.e. wetting of the particle material, at the infiltration front of the molten metal. The capillary forces of the preform act as the driving force for the infiltration of the noble metal into the preform.

Finally, the molten metal of the composite is solidified within the interstitial spaces of the preform by cooling the particle reinforced noble metal matrix composite to about room temperature. The resulting particle reinforced noble metal matrix composite includes a noble metal content of at least 56% by weight, advantageously about 56% to 75% by weight, and desirable characteristics as discussed below.

Accordingly, various exemplary embodiments of the particle reinforced noble metal matrix composites of the present invention will now be described along with the infrared heating process used for making them.

Materials

Each of the noble metal matrix materials used in the examples below was obtained from the Stueller Settings company of Lafayette, La., in the form of casting grains. Five different noble metal matrix materials, identified as A, B, C, D, E, and F, are described in Table 1 below. These noble metals were used in producing the particle reinforced noble metal matrix composites listed in Tables 2-7, which respectively also are identified as A, B, C, D, E, and F based on the noble metal contained therein.

TABLE 1

Composition and Characteristics of Noble metals Used

| Group No. | Noble metal | Composition and Characteristics |
|---|---|---|
| A | Gold alloy | 14 k gold with 39.00% copper, 2.00% silver, and 0.40% zinc<br>M.P. 931° C.<br>Red in color |
| B | Gold alloy | 14 k gold with 2.00% copper, 39.00% silver, and 0.40% zinc<br>M.P. 958° C.<br>Green in color |
| C | Gold alloy | 14 k gold with 29.00% copper, 8.00% silver, and 4.50% zinc<br>M.P. 861° C.<br>Bright yellow in color |
| D | Gold alloy | 14 k gold with 25.50% copper, 9.00% zinc, and 7.50% nickel<br>M.P. 946° C.<br>Yellowish white in color |
| E | Pure gold | 24 k<br>M.P. 1064.4° C.<br>Yellow in color |
| F | Pure Silver | 99.99% Silver<br>M.P. 961.8° C.<br>Silver in color |

With specific reference to gold, as is commonly understood in the art, gold purity may be indicated by the karat, which is a unit of fineness equal to $1/24^{th}$ part of pure gold. As such, 24 karat (24 k) gold is pure gold; 18 k is $18/24$ths or about 75% gold; 14 k is $14/24$ths or about 58.33% gold; and 10 k is $10/24$ths or about 41.67% gold.

Particle Material

The specific particle reinforcing materials used in the below discussed composites, as included in Tables 2-7, are molybdenum carbide and tungsten carbide.

The tungsten carbide was obtained from Alfa Aesar of Ward Hill, Mass., in the form of a powder. Two different tungsten carbide powders, hereinafter referred to as Powders #1 and #2, were obtained and used. Powder #1 includes a purity of 99.5% and has an average particle size of no greater than 1 μm. Powder #2 includes a purity of 99.75 and has particles sizes in the range of 44 to 149 μm. It is specifically noted that Powder #1 is used in each of the Table 2 composites while a 50/50 mixture by weight of Powder #1 and Powder #2 is used in each of the Table 3 composites.

The molybdenum carbide material similarly is obtained from Alfa Aesar of Ward Hill, Mass., in the form of a powder. The molybdenum carbide powder includes 99.5% purity and has particles sizes in no greater than 44 μm.

Experimental Methodology

Each of the particle reinforced noble metal composites (A-F), identified in Tables 2-7, are made according to the below described experimental methodology.

Preform Casting and Noble Metal Preparation

In preparation for composite formation, the particle powder material, i.e. the tungsten or molybdenum carbide powder, is cast to form a generally cylindrically shaped preform. More specifically, agglomerations of the powder are broken down using sieving, the mortar and pestle grinder, or any other commonly known technique. About 1.40 grams to 2.00 grams of powder, as indicated in Tables 2, 3, and 4, is weighed out using a digital balance to an accuracy of plus or minus 0.01 grams. The weighed powder is poured into a cylindrical die made of steel that has been thoroughly cleaned with acetone, dried, and lubricated with silicone lubricant to provide a smooth surface for the powder to be compacted. The die, containing the powder, is then subjected to cold hand pressing followed by mechanical compaction at a pressure of about 44,792 psi to produce cylindrical preforms having a diameter of about 0.377 inches and a height of about 0.150 inches. The particular green density for each preform was determined, by methods commonly known in the art, and is indicated in each of Tables 2, 3, and 4.

Concerning the noble metal grains characterized above in Table 1, each noble metal is cast into a block, by methods commonly known in the art, and the weight thereof is determined and indicated in Table 2, 3, and 4 below.

Heating, and Cooling

For composite formation, a graphite crucible of 9.7 mm inner diameter is used to hold the preform and noble metal block. The preform first is loaded carefully into the graphite crucible to avoid cracking. The noble metal block is polished to remove an oxide layer, if applicable, then cleaned with acetone and deionized water, ultrasonically, and placed on top of the preform. The entire assembly then is placed in an infrared furnace and subjected to pressureless infrared heating, i.e. infrared heating at a standard atmospheric pressure of 1 atm, under an argon atmosphere.

The furnace chamber is heated, or superheated, by a tungsten halogen lamp at a rate of no greater than about 100° C./sec, advantageously about 80° C./sec, from about room temperature to about 1250° C. to produce a molten noble metal. The infrared light advantageously has a wavelength of from about 0.6 to about 10 μm. The temperature during the process is monitored and controlled by using an S-type or a Pt/Pt-10% Rh thermocouple that is secured to the bottom of the crucible. The capillary forces of the preform act as the driving force for the infiltration of the noble metal into the preform. The noble metal is allowed to infiltrate the carbide preform at about 1250° C. for a period of about 240 seconds to form the particle reinforced noble metal matrix composite. The furnace chamber is provided with a vent to evacuate the argon gas when the molten metal flows down through the porous preform. Then, the composite is cooled to about room temperature, advantageously at a rate of about 20° C./sec.

The composites, thus obtained, include a noble metal content of at least 56% by weight, and were subjected to various characterization techniques immediately after infiltration for determination of density, hardness, and resistivity as discussed below with results being illustrated in Tables 5, 6, and 7. In addition, each composite consisted of a certain color as a result of the noble metal used therein. More specifically, composite A was pink, B was green, C was yellow, D was white, E was yellow, and F was silver in color.

Group 1: Tungsten Carbide (WC) Particle Reinforced Noble Metal Matrix Composite

TABLE 2

| Particle Reinforced Noble metal Matrix Composite | Mass of Noble metal (gm) | Mass of WC (gm) | Pre-Infiltration (Green) Pellet Density (gm/cc) | Temperature (° C.) | Time (sec.) |
|---|---|---|---|---|---|
| A | 3.0105 | 2.0016 | 8.046 | 1250 | 240 |
| B | 3.0105 | 2.0020 | 8.047 | 1250 | 240 |
| C | 2.5169 | 2.0050 | 8.059 | 1250 | 240 |
| D | 2.5074 | 2.0035 | 8.053 | 1250 | 240 |
| E | 1.5904 | 1.6741 | 8.028 | 1250 | 240 |
| F | 2.5500 | 1.6500 | 8.040 | 1250 | 240 |

Group 2: Mixed Tungsten Carbide Particle Reinforced Noble Metal Matrix Composite

TABLE 3

| Particle Reinforced Noble metal Matrix Composite | Mass of Noble metal (gm) | Mass of WC (gm) | Pre-Infiltration (Green) Pellet Density (gm/cc) | Temperature (° C.) | Time (sec.) |
|---|---|---|---|---|---|
| A | 2.5354 | 1.9614 | 9.748 | 1250 | 240 |
| B | 2.5152 | 1.9440 | 9.750 | 1250 | 240 |
| C | 2.5282 | 1.9430 | 9.745 | 1250 | 240 |
| D | 2.5232 | 1.9410 | 9.735 | 1250 | 240 |
| E | 2.5570 | 1.5870 | 8.033 | 1250 | 240 |

Group 3: Molybdenum Carbide Particle Reinforced Noble Metal Matrix Composite

TABLE 4

| Particle Reinforced Noble metal Matrix Composite | Mass of Noble metal (gm) | Mass of MoC (gm) | Pre-Infiltration (Green) Pellet Density (gm/cc) | Temperature (° C.) | Time (sec.) |
|---|---|---|---|---|---|
| A | 2.0459 | 1.4525 | 5.294 | 1250 | 240 |
| B | 2.1273 | 1.4484 | 5.279 | 1250 | 240 |
| C | 2.0347 | 1.4654 | 5.341 | 1250 | 240 |
| D | 2.1692 | 1.9697 | 5.384 | 1250 | 240 |
| E | 2.5500 | 1.4500 | 5.290 | 1250 | 240 |

Control Group 4: Noble metals (A-F) with no Reinforcing Material

The density, hardness, and resistivity of each of the prepared particle reinforced noble metal matrix composites is further compared in Tables 5, 6, and 7 against control Group 4. Control Group 4 includes the noble metals (A-F), as characterized in Table 1, minus the particle reinforcing material. Each of the Group 4 noble metals and metal alloys are subjected to the same processing steps as above described.

Methods Used to Determine Physical Properties of Composite Density

The densities of each prepared composite from Table 2 (Group 1), Table 3 (Group 2), and Table 4 (Group 3) are listed in Table 5 below. To measure the density, each composite is cut into a rectangular block by a high-speed saw having a diamond blade. Prior to characterization, excess noble metal on the composite surface was removed with cutting and grinding. Density was determined using Archimedes principle of water displacement using a Mettler H54AR suspension balance. Each composite was weighed in air, then in de-ionized water. The weight difference between the air and water was used to calculate the sample volume. The water density was taken to be 1 gm/cm$^3$.

The composites showed good resulting density as determined by microstructural examination using means, e.g. optical microscope means, commonly known in the art. Micro images indicated that infiltration was essentially complete and that resulting pores sizes were negligible. In addition, good resulting density can be shown in relation to theoretical densities by utilizing the rule of mixtures for composites, as is commonly known in the art. Overall, the density values of the particle reinforced noble metal matrix composites as determined by microstructural analysis is believed to be at least about 97% and greater of the theoretical density value.

Resulting Properties of Particle Reinforced Noble metal Matrix Composites

TABLE 5

| | DENSITY (gm/cc) | | | |
|---|---|---|---|---|
| Particle Reinforced Noble metal Matrix Composite | Group 1 (tungsten carbide, Powder #1) | Group 2 (tungsten carbide, mixed 50/50) | Group 3 (molybdenum carbide) | Control Group 4 (no reinforcing material) |
| A | 12.698 | 14.730 | 10.490 | — |
| B | 13.610 | 14.980 | 11.090 | — |
| C | 12.701 | 14.920 | 10.530 | — |
| D | 12.973 | 14.320 | 10.190 | — |
| E | 15.308 | 16.486 | 11.320 | 19.3 |
| F | 13.150 | — | — | 10.5 |

Hardness

The hardness of each prepared composite from Table 2 (Group 1), Table 3 (Group 2), and Table 4 (Group 3) is listed in Table 6 below. To measure the hardness, each composite is cut into a rectangular block by a high-speed saw having a diamond blade. Hardness was considered to be a measure of wear resistance which was measured using a Vicker's hardness tester, M-400-H1 obtained from Leco of St. Joseph, Mich., at a constant load of 100 gm and dwelling time of 15 seconds for each composite. At least 10 measurements were done for each sample. The average value was taken after removing the highest and lowest value.

With specific reference to pure gold and pure silver, the hardness value is about 216 VHN and 251 VHN respectively. In comparison, composites E (pure gold) and F (pure silver) in Group 1 show a significant improvement in hardness over pure gold and pure silver respectively. In addition, the hardness value, or wear resistance, of the other composites (A-D) in Groups 1, 2, and 3 is significantly greater than pure gold or pure silver as well as their corresponding composite in Control Group 4. In fact, almost all of the gold alloy composites in Groups 1-3 show greater than a 100% increase of hardness over pure gold and silver.

TABLE 6

| Particle Reinforced Noble metal Matrix Composite | HARDNESS (VHN) Group 1 (tungsten carbide, Powder #1) | Group 2 (tungsten carbide, mixed 50/50) | Group 3 (molybdenum carbide) | Group 4 (no reinforcing material) |
|---|---|---|---|---|
| A | 517.15 | 517.15 | 409.34 | 139.60 |
| B | 407.01 | 407.01 | 341.20 | 83.17 |
| C | 532.39 | 532.39 | 455.95 | 137.87 |
| D | 582.35 | 582.35 | 483.51 | 152.53 |
| E | 245.34 | — | 171.24 | 82.73 |
| F | 366.94 | — | — | 86.42 |

Resistivity

The resistivity of each prepared composite from Table 2 (Group 1), Table 3 (Group 2), and Table 4 (Group 3) is listed in Table 7 below. To measure the resistivity, each composite is machined so as to form a square bar having the following dimensions: 0.9×0.35×0.25 cm. The electrical resistivity is assessed using a four-point-probe technique, and more specifically a C4S-64/5S four-point probe, at a constant current of 2 Amp. The spacing between the probes is 0.159 cm. The resistivity was calculated by the following equation:

$$\rho=\pi\times V/ln2\times I$$

where ρ is the resistivity (Ω-cm), V is the output voltage (V),and I is the input current (Amp). About seven readings were taken with each composite and the average value was calculated after removing the highest and lowest value.

With specific reference to pure gold and pure silver, the resistivity is about $2.2\times10^{-6}$ Ω-cm and $1.6\times10^{-6}$ Ω-cm respectively. Notably, the resulting resistivity of the particle reinforced noble metal composites for all Groups is similar to the resistivity of their respective pure noble metal. This similarity suggests that pores in the composite do little to affect the electrical properties thereof and confirms the homogenous microstructure and presence of a continuous network of noble metal matrix surrounding the carbide particles.

TABLE 7

| Particle Reinforced Noble metal Matrix Composite | RESISTIVITY (Ω-cm) Group 1 (tungsten carbide, Powder #1) | Group 2 (tungsten carbide, mixed 50/50) | Group 3 (molybdenum carbide) | Group 4 (no reinforcing material) |
|---|---|---|---|---|
| A | 4.31679E−05 | 3.60896E−05 | 8.2149E−05 | 2.652E−05 |
| B | 4.67570E−05 | 4.55606E−05 | 6.8092E−05 | 2.791E−05 |
| C | 5.31374E−05 | 6.80917E−05 | 8.7333E−05 | 3.370E−05 |
| D | 7.44722E−05 | 8.43420E−05 | 1.3249E−04 | 7.328E−05 |
| E | 2.67183E−05 | — | 5.5032E−05 | 1.376E−05 |
| F | 4.98000E−06 | — | — | 9.380E−06 |

Accordingly, the infrared heating process of the present invention produces a particle reinforced noble metal matrix composite having desirable properties, such as sufficient hardness and/or low resistivity. The resulting composites advantageously can be prepared in a short period of time and can be used in the jewelry industry, such as for making watches, rings, and other jewelry, and/or in the power, automobile, and aircraft industries, such as for making electrical contact materials.

While the present invention has been illustrated by a description of various versions, and while the illustrative versions have been described in considerable detail, it is not the intention of the inventor(s) to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the inventor's (inventors') general inventive concept.

What is claimed is:

1. A particle reinforced noble metal matrix composite, consisting of:

a noble metal selected from gold or alloys thereof and a particle material selected from a carbide, wherein the particle reinforced noble metal matrix composite includes a noble metal content between 56% and 75% by weight, a Vickers hardness of at least about 171, and a density value of at least about 97% of a theoretical density value.

2. The particle reinforced noble metal matrix composite of claim 1 wherein the carbide includes tungsten carbide or molybdenum carbide.

3. The particle reinforced noble metal matrix composite of claim 1 wherein the particle reinforced noble metal matrix composite includes a Vickers hardness of at least about 216.

* * * * *

UNITED STATES PATENT AND TRADEMARK OFFICE

CERTIFICATE OF CORRECTION

PATENT NO. : 7,608,127 B2
APPLICATION NO. : 12/035798
DATED : October 27, 2009
INVENTOR(S) : Ray Y. Lin et al.

It is certified that error appears in the above-identified patent and that said Letters Patent is hereby corrected as shown below:

On the Title Page, Page 2, under Item (56) "Other Publications"

Line 5, "Metallirgica" should be --Metallurgica--.

Line 8, "Matallurgica" should be --Metallurgica--.

Column 2

Line 9, delete "also referred to as noble metals,".

Line 24, "results" should be --result--.

Column 3

Line 49, "composite include" should be --composite includes--.

Column 4

Line 57, "period of sufficient" should be --period of time sufficient--.

Column 5

Line 15, "Five" should be --Six--.

Column 6

Line 4, "particles sizes in no greater" should be --particle sizes no greater--.

Line 7, "are made" should be --is made--.

Signed and Sealed this

Second Day of November, 2010

David J. Kappos

David J. Kappos
*Director of the United States Patent and Trademark Office*

Column 8

Line 27, “is believed” should be --are believed--.